US007594534B2

(12) United States Patent
Marti et al.

(10) Patent No.: US 7,594,534 B2
(45) Date of Patent: Sep. 29, 2009

(54) METHOD FOR OPERATING A STRIP CASTING MACHINE FOR PRODUCING A METAL STRIP AND DEVICE FOR CARRYING OUT SAID METHOD

(75) Inventors: Heinrich Marti, Forch (CH); Jaques Barbè, Tarantaise (FR)

(73) Assignees: SMS Demag AG, Düsseldorf (DE); Main Management Inspiration AG, Hergiswil (CH)

( * ) Notice: Subject to any disclaimer, the term of this patent is extended or adjusted under 35 U.S.C. 154(b) by 588 days.

(21) Appl. No.: 10/573,249

(22) PCT Filed: Oct. 7, 2004

(86) PCT No.: PCT/EP2004/011210

§ 371 (c)(1),
(2), (4) Date: Mar. 23, 2006

(87) PCT Pub. No.: WO2005/035170

PCT Pub. Date: Apr. 21, 2005

(65) Prior Publication Data

US 2007/0051487 A1 Mar. 8, 2007

(30) Foreign Application Priority Data

Oct. 8, 2003 (CH) ..... 1708/03

(51) Int. Cl.
*B22D 11/06* (2006.01)
*B22D 11/051* (2006.01)
*B22D 11/053* (2006.01)

(52) U.S. Cl. ..... 164/480; 164/416; 164/428; 164/478

(58) Field of Classification Search ..... None
See application file for complete search history.

(56) References Cited

U.S. PATENT DOCUMENTS 6,296,046 B1 10/2001 Jeong et al.

FOREIGN PATENT DOCUMENTS

| | | | |
|---|---|---|---|
| DE | 100 56 916 | A1 | 5/2002 |
| EP | 0 575 617 | A1 | 12/1993 |
| JP | 2000-117397 | | 4/2000 |
| WO | 01/23121 | A1 | 4/2001 |

*Primary Examiner*—Kuang Lin
(74) *Attorney, Agent, or Firm*—Wenderoth, Lind & Ponack, L.L.P.

(57) ABSTRACT

The invention relates to a method for operating a strip casting machine for producing a metal strip during which molten metal is continuously poured between two casting rolls (3, 4) that form a casting gap. Sealing plates (2*b*) are provided for laterally delimiting the casting gap, whereby the sealing plates (2*b*) are displaced during the casting operation in an oscillating manner transversal to the direction of the axis of the casting rolls (3,) counter to the front surface (3*a*, 4*a*) of said casting rolls (3, 4). Said sealing plates (2*b*) are displaced in an oscillating manner in and counter to the direction of the periphery ($U_3$ and/or $U_4$) of the casting rolls (3, 4), whereby displacement takes place in an alternating manner along one or the other casting roll edges (3*k* and/or 4*k*). Partial solidifcations can, to a large extent, be prevented from forming and can be removed if need be. The produced metal strip has clean edges.

20 Claims, 8 Drawing Sheets

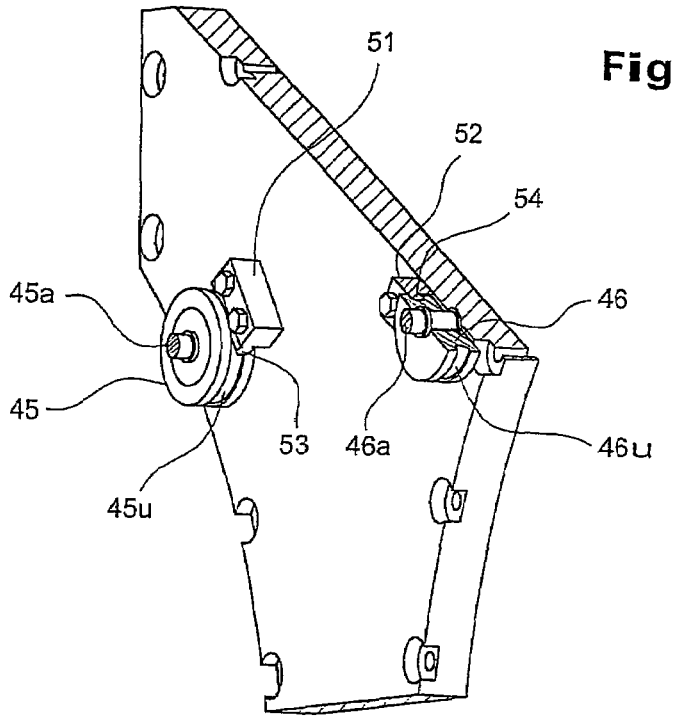
Fig. 7
Fig. 8
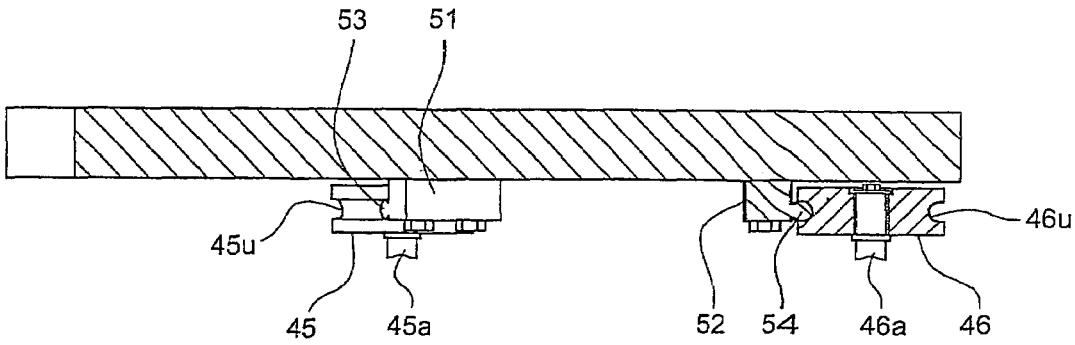

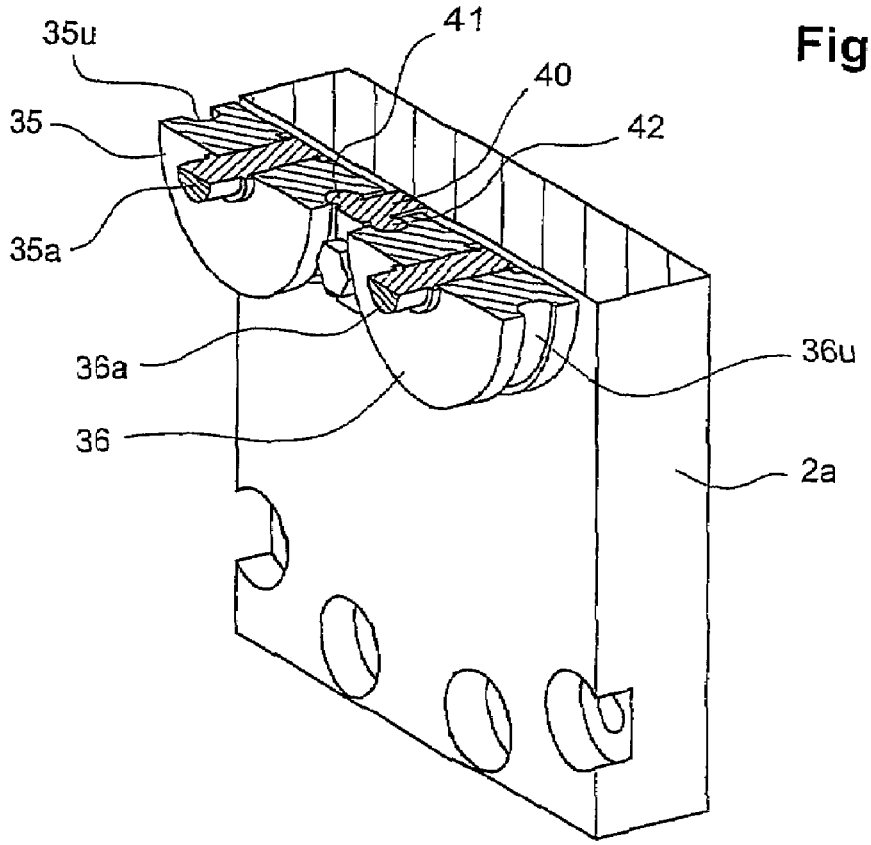
Fig. 9
Fig. 10
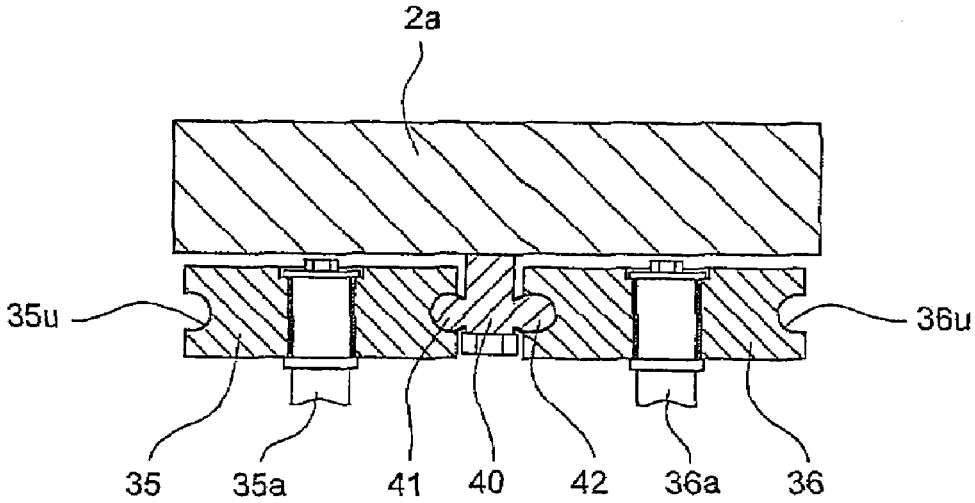

METHOD FOR OPERATING A STRIP CASTING MACHINE FOR PRODUCING A METAL STRIP AND DEVICE FOR CARRYING OUT SAID METHOD

BACKGROUND OF THE INVENTION

The invention concerns a method for operating a strip casting machine for producing a metal strip, and a device for carrying out the method.

During casting between two casting rolls forming a casting gap, sealing plates are held against the facing surfaces of the casting rolls to contain and hold the molten metal between the rolls. The fire-proof sealing plates are mainly pressed against the rotating casting rolls. During this, the sealing surfaces are subjected to substantial wear. In the area of the sealing edges, an undesired partial solidification can occur, which in turn may result in damage to the sealing plates along the roll edges. The wash-out, i.e. the wear from the sealing plates within the edge area of the casting rolls will result in poorly cast edges in the metal strip and in the formation of fins in this area. The metal strip with possible fins produced in this way can cause further wear on the sealing plates on the one hand, and can give rise to edge cracks in the metal strip on the other. These defects will necessitate substantial edge trimming and therefore reject losses, which will have a negative effect on the efficiency of the method.

Strip casting machines are known where the side seals can be moved or rotated in an oscillating manner in a horizontal or vertical direction in order to avoid uneven wear of the sealing plates, and also to prevent an adhering of the metal strip produced. However, even with these solutions, the risk of a possible partial solidification occurring in the area of the roll edges between the sealing plate and the facing side of the rolls still exists, and partial wear on the one hand as well as strip edge faults on the other may result.

SUMMARY OF THE INVENTION

It is therefore the task of this invention to provide a method of the type mentioned above, as well as a device for carrying out the method, with which the strip edge quality can be substantially improved and the efficiency of the method increased.

This task is solved in accordance with the invention by a method as well as a device of type described below.

Preferred embodiments of the method of the invention and the device of the invention form the subject of the dependent subclaims.

According to the invention, the sealing plates are moved inwardly and against the direction of periphery of the casting rolls in an oscillating manner during the casting operation, whereby the movement occurs alternately along one or the other casting roll edge. Thus the occurrence of a partial solidification can be mostly prevented and possibly removed, and the metal strip produced in this way will comprise clean strip edges. Strip edge cracks as well as strong signs of wear on the sealing plates will be prevented, which will in turn increase the efficiency of the method (reject losses due to substantial edge cutting is avoided, and longer casting sequences are possible).

BRIEF DESCRIPTION OF THE DRAWINGS

The invention will now be described in more detail with reference to the drawings, whereby:

FIG. 7 shows a perspective and a cross-sectional view of a lower part of the device of FIG. 1;

FIG. 8 shows an overview of the part of FIG. 7;

FIG. 9 shows a perspective and a cross-sectional view of an upper part of FIG. 1;

FIG. 10 shows an overview of the part of FIG. 9; and

DETAILED DESCRIPTION OF THE INVENTION

Figure 1:
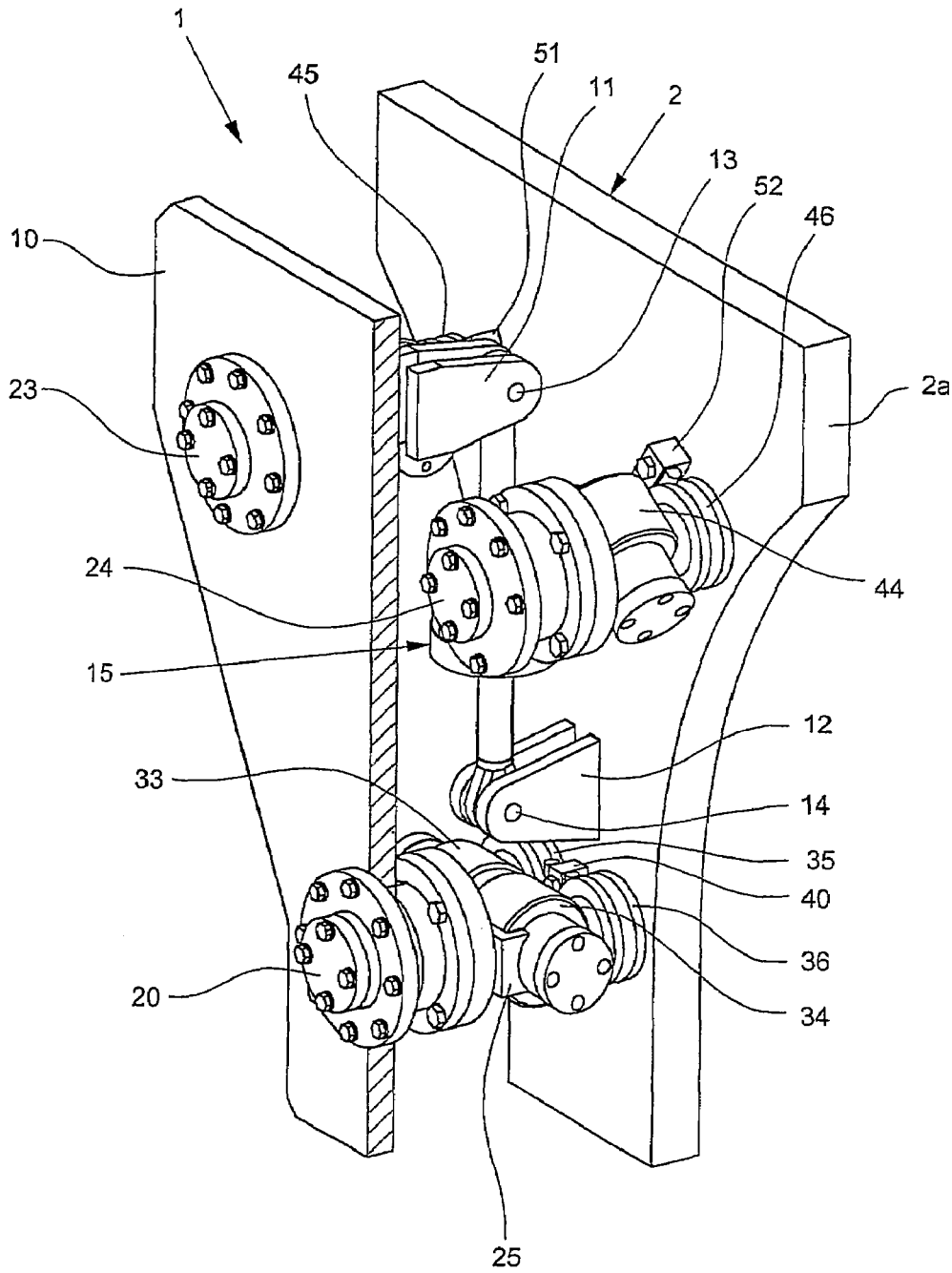
FIG. 1 shows a perspective illustration of a first embodiment of a device for producing oscillating movements at the side seals of the roll strip casting machine.
Figure 2:
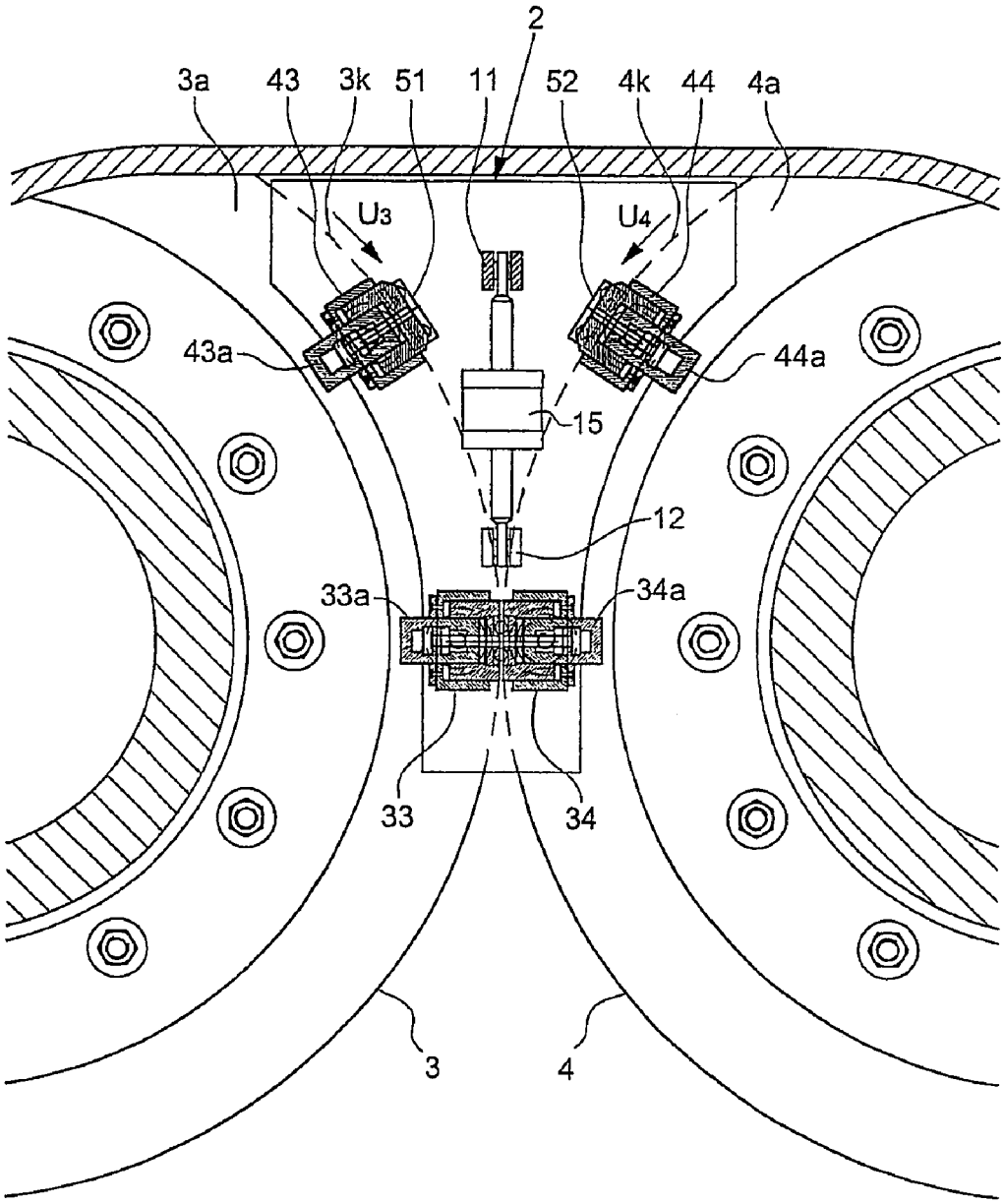
FIG. 2 shows a cross-sectional view of a part of the roll strip casting machine with the device according to FIG. 1.
Figure 3:
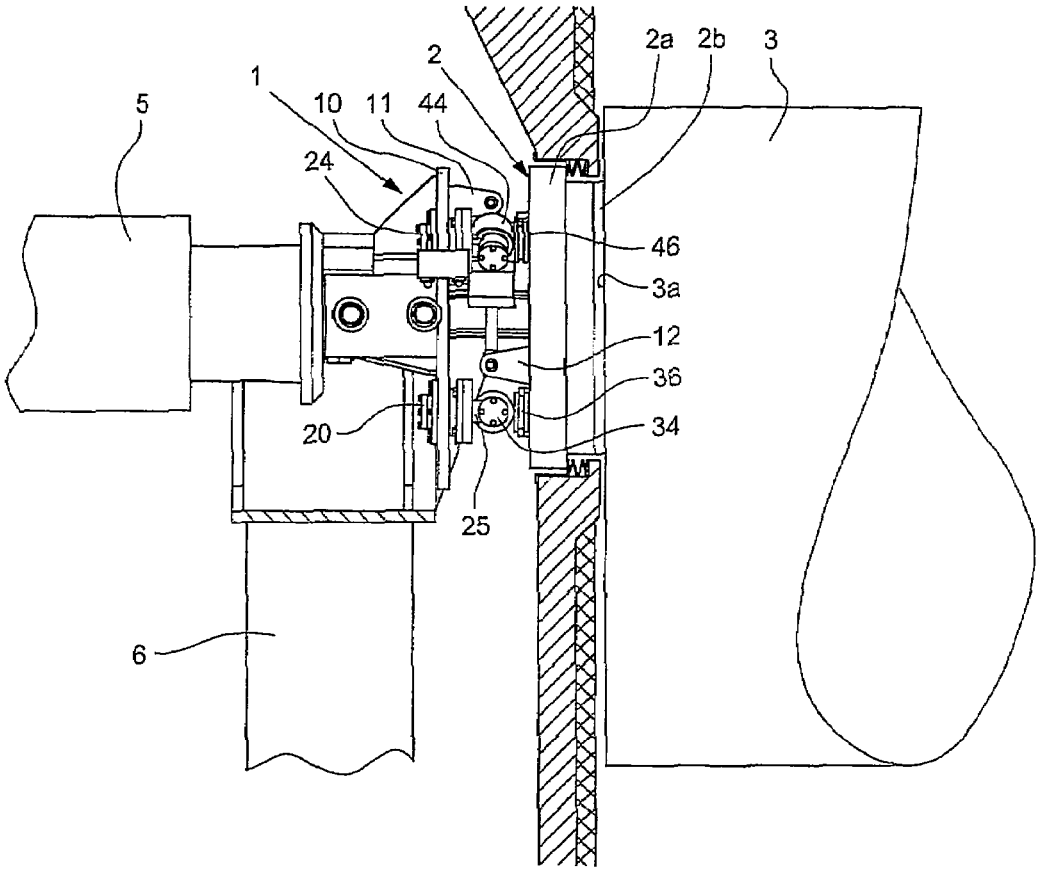
FIG. 3 shows a side view of a part of the roll strip casting machine with the device of FIG. 1.

FIGS. 1 to 3 show a device 1 for producing oscillating movements at the side seals 2 of a roll strip casting machine which is envisaged for producing a metal strip by continuously pouring molten metal between two casting rolls forming a casting gap. The casting rolls can be seen in FIG. 2 and have been allocated the reference numbers 3, 4. Two side seals 2 located at both facing sides of the casting rolls 3,4 limit the longitudinal expansion of the casting gap and therefore determine the width of the metal strip to be produced. One device 1 each is envisaged for the relevant side seals 2.

Figure 4:
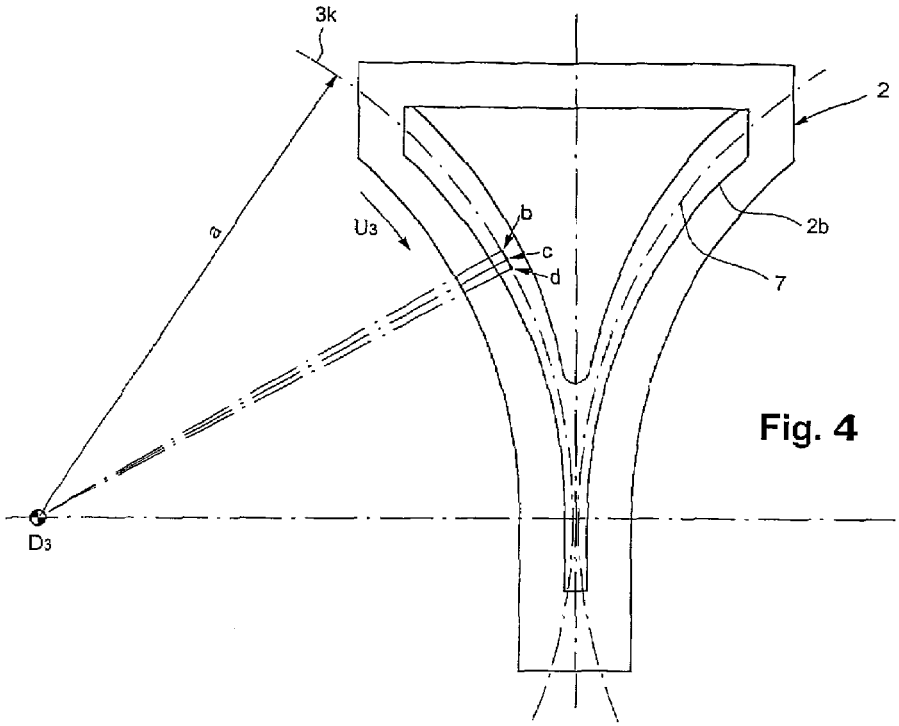
FIG. 4 shows a schematic view of a side seal.
Figure 5:
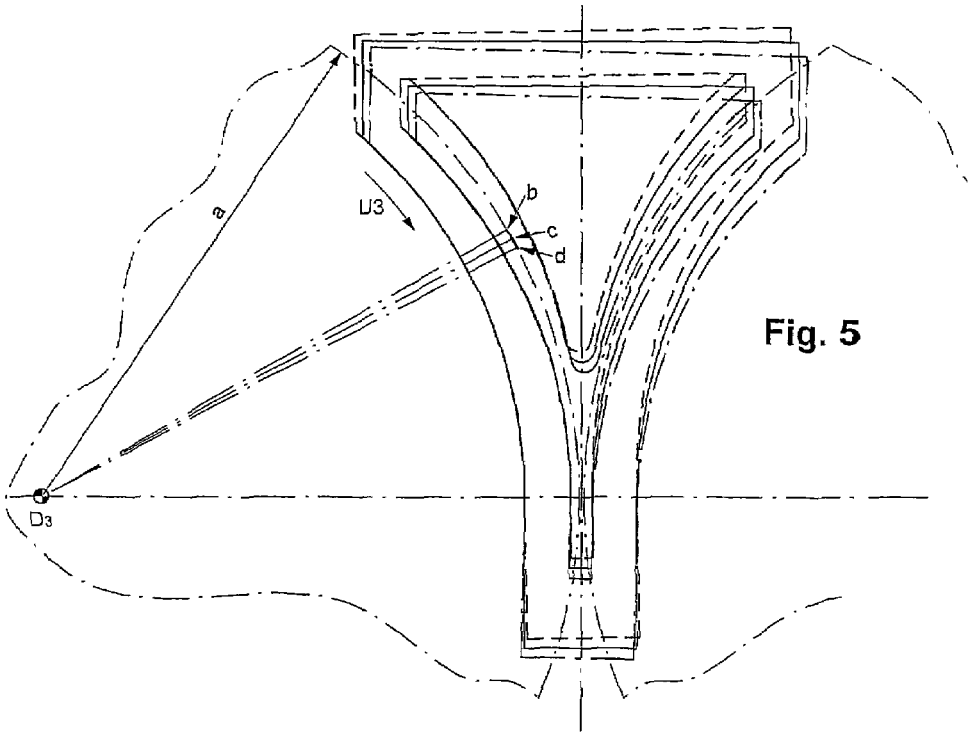
FIG. 5 shows a schematic view of the side seal of FIG. 4 during the oscillating movement along a first casting roll edge.
Figure 6:
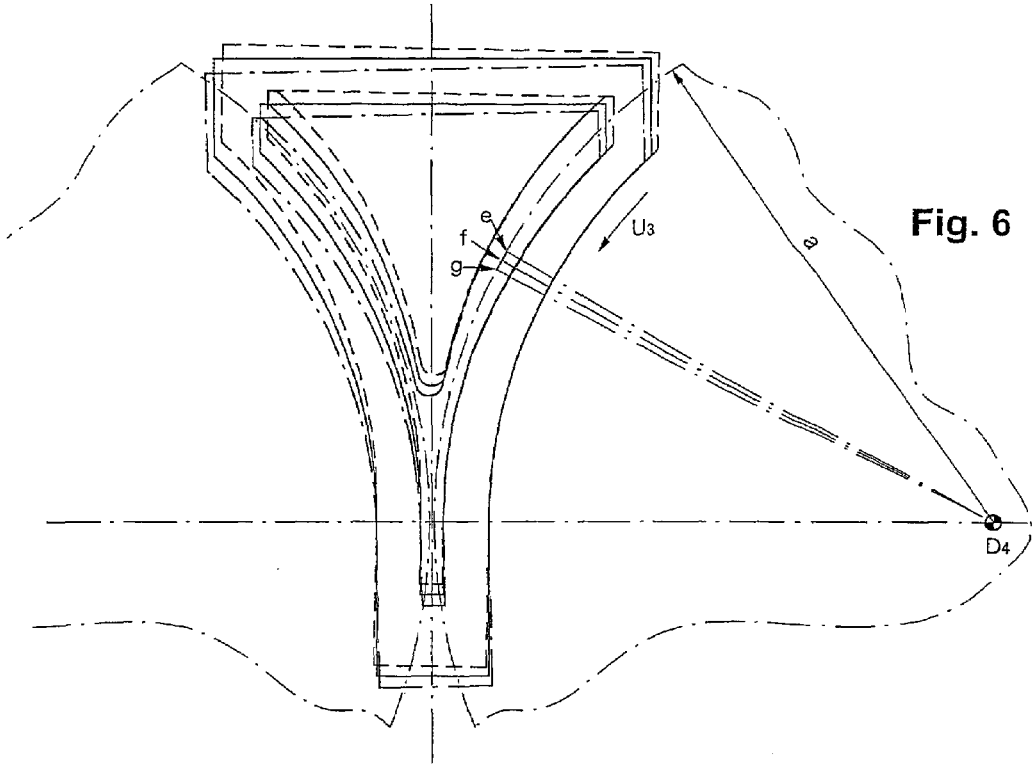
FIG. 6 shows a schematic view of the side seal of FIG. 4 during the oscillating movement along a second casting roll edge.

The side seals 2 each comprise one fire-proof sealing plate located in a holding frame 2*a* (see FIG. 3), which can be adjusted against the facing surfaces 3*a*, 4*a* of the casting rolls 3, 4 by means of an adjustment device 5 that in itself is known and does not need to be described in detail here. The adjustment device 5 is located on a frame 6. The adjustment device 5 is allocated to a base plate 10 of the device 1. On the base plate 10 on the one hand, and on the holding frame 2*a* of the side seal 2 on the other, a fork-shaped holder 11, 12 each is affixed, the vertically extending shanks of which are connected with each other with a horizontally aligned transverse bolt 13, 14. On the two transverse bolts 13, 14, a substantially vertically orientated piston/cylinder unit is located, the same being slightly tiltable in relation to a vertical plane extending parallel to the base plate 10 and to the side seal 2, for which the inside surfaces of the shanks can for example take on a slightly convex form at both holders 11, 12. The piston/cylinder unit is connected with a drive in a way not shown in detail here, and has the purpose of creating an oscillating movement of the side seals 2 with its up/down movement. The oscillating movement is not vertical according to the invention, but extends against the direction of periphery $U_3$, i.e. $U_4$ (FIG. 2) of the casting rolls 3, 4, namely alternately along one or the other casting roll edge 3*k*, i.e. 4*k* as shown in FIGS. 5 and 6. In this way each point of the so-called sealing area 7 of the sealing plate 2*b* is set—as illustrated in FIGS. 4 and 5—from a neutral position c into an oscillating movement at the circumference of a circle with a center $D_3$ (axis of rotation of the casting roll 3) and with the roll radius a in the direction of periphery $U_3$, i.e. in the casting direction, up to the lower dead point d and back against the direction of periphery $U_3$ up to an upper dead point b. FIG. 6 shows that each point of the sealing area 7 can also oscillate from a neutral position f on the circumference of a circle with a center $D_4$ (axis of rotation of the casting roll 4) and with the roll radius a in the direction of periphery $U_4$ between a lower dead point g and an upper dead point e.

To convert the oscillating up/down movement created by the piston/cylinder unit into the oscillating movement of the side seals 2 according to the invention as described above the side seals 2 on the one hand, and the locationally fixed base plate 10 on the other, are allocated guide elements, the first part of which is envisaged for steering the side seals 2 along one casting roll edge 3*k*, and the second part of which for steering the side seals 2 along the other casting roll edge 4*k*. In addition, adjustment means are provided with which the first or the second part of the guide elements can be used alternately. These guide elements as well as the adjustment means will now be described in more detail with reference to FIGS. 1 to 3 as well as FIGS. 7 to 10.

On the base plate 10 three position cylinders 20, 23, 24 (see FIGS. 1 and 3) are located, preferably screwed into the base plate 10, of which one, the position cylinder 20, is located in the lower area of the device 1 in such a way that its axis extends in the area of the casting gap, i.e. substantially along a plane that is common to both of the casting roll axis $D_3$, $D_4$. The two other position cylinders 23, 24 are positioned symmetrically in relation to the vertical central axis of the base plate 10, i.e. the side seals 2 in the upper area of the device 1, i.e. they are allocated within the expanded area of the side seal 2 and are located at both sides of the fork-shaped holder 11 for the piston/cylinder unit.

The lower position cylinder 20 is equipped with a holder 25 for two guide cylinders 33, 34 arranged horizontally at a right angle to the position cylinder 20 and facing each other, and the adjustable pistons 33*a*, 34*a* of the holder 25 each serve as support for a guide roll 35, 36.

As is also visible from FIGS. 9 and 10, the guide rolls 35, 36 are bearingly and rotatably positioned on bolts 35*a*, 36*a* which are aligned at right angles to the pistons 33*a*, 34*a* and connected with the same. With the pistons 33*a*, 34*a*, the guide rolls 35, 36 can be pressed against a lower circular guide 40 fitted, and preferably screwed, to the side seals 2, i.e. the holding frame 2*a* of the same on both sides. The cross-section of the circular guide 40 comprises rounded outside guide surfaces 41, 42 which co-operate with similarly formed circumferential surfaces 35*u*, 36*u* of the guide rolls 35, 36. The lower position cylinder 20 as well as the lower circular guide 40 are located below the lower holder 12 for the piston/cylinder unit 15.

The upper position cylinders 23, 24 also each comprise a guide cylinder 43, 44 (see especially FIG. 2), the pistons 43*a*, 44*a* of which each serve as a support for a guide roll 45, 46. The guide rolls 45, 46 in turn are bearingly and rotatably positioned on bolts 45*a*, 46*a* positioned at right angles to the pistons 43*a*, 44*a* (see FIGS. 7 and 8). On the side seal 2, i.e. the holding frame 2*a* two upper circular guides 51, 52 of the same are affixed (i.e. screwed on in the upper area), which are each equipped with a side guide surface 53, 54 facing the outside edge of the side seal 2. The rounded guide surfaces 53, 54 with their outwardly dome-shaped cross-section each co-operate with correspondingly shaped circumferential surfaces 45*u*, 46*u* of the guide rolls 45, 46.

The upper circular guides 51, 52 are arranged in such a way that their guide surfaces 53, 54 each lie along the circumference of the circle with the radius a and the center $D_3$ (circular guide 51), or $D_4$ (circular guide 52) already mentioned above. Around the circumference of the relevant circle, the relevant outside surface 41, 42 of the lower circular guide 40 is also located. The upper guide cylinders 43, 44 are aligned in such a way that the guide rolls 45, 46 are adjusted at a right angle to the relevant guide surfaces 53, 54 during the adjustment of its pistons 43*a*, 44*a* to bring them into tangential contact with the same. As already mentioned, the pistons 33*a*, 43*a* and pistons 34*a*, 44*a* are activated alternately according to this invention, and the guide rolls 35, 45 are therefore alternately pressed against the guide surfaces 41, 53. Then the guide rolls 36, 46 are pressed against the guide surfaces 42, 54, so that the oscillating up/down movement of the piston/cylinder unit 15 alternately oscillates the side seals 2 as shown in FIG. 5, and then as shown in FIG. 6.

Instead of a single lower circular guide 40 with two outside surfaces 41, 42, it is of course also possible to use two separate circular guides with one outside surface each affixed to the holding frame 2*a*.

Instead of the piston/cylinder unit 15, it is also possible to use a different conventional drive unit for generating the up and down movements.

The oscillating frequency can be varied, whereby the movement of the side seals 2 (i.e. the fire-proof sealing plates 2*b* integrated into the same) in the direction of periphery $U_3$, or $U_4$ of the casting rolls 3, 4, (i.e. the casting direction), can be a little faster, the same, or even substantially slower than the movement of the rotating surface of the casting rolls 3, 4. In other words: a minimal prior advance, an equal advance, or possibly even a substantially lower advance is possible.

The movement of the sealing plate 2*b* against the direction of periphery $U_3$, or $U_4$ of the casting rolls 3, 4 (i.e. the return movement) can be faster, the same, or even substantially slower than the casting direction movement mentioned above.

The oscillating frequency can vary depending on the casting speed. For a simple control, the oscillating frequency can however also be fixed to suit a conventional casting speed.

The lift of the sealing plates 2*b* can preferably be +/− 0.5 to +/− 10 mm and occur at a speed that is up to 10% faster during the casting direction movement, and up to 10 times slower during the return movement.

The fact that according to the invention, the side seals 2 (i.e. the fire-proof sealing plates 2*b* integrated into the same) are moved in an oscillating way in and against the direction of periphery $U_3$, or $U_4$ of the casting rolls 3, 4 during the casting operation, whereby the movement can occur alternately along one or the other casting roll edge 3*k*, 4*k* means that the creation of partial solidifications can be mostly prevented and removed if need be, and that the resulting metal strip can be produced with clean strip edges. Strip edge cracks as well as strong signs of wear on the sealing plates 2*b* can be avoided, so that the efficiency of the method is increased (reject losses due to substantial edge cutting are prevented, and longer casting sequences are possible).

Figure 11:
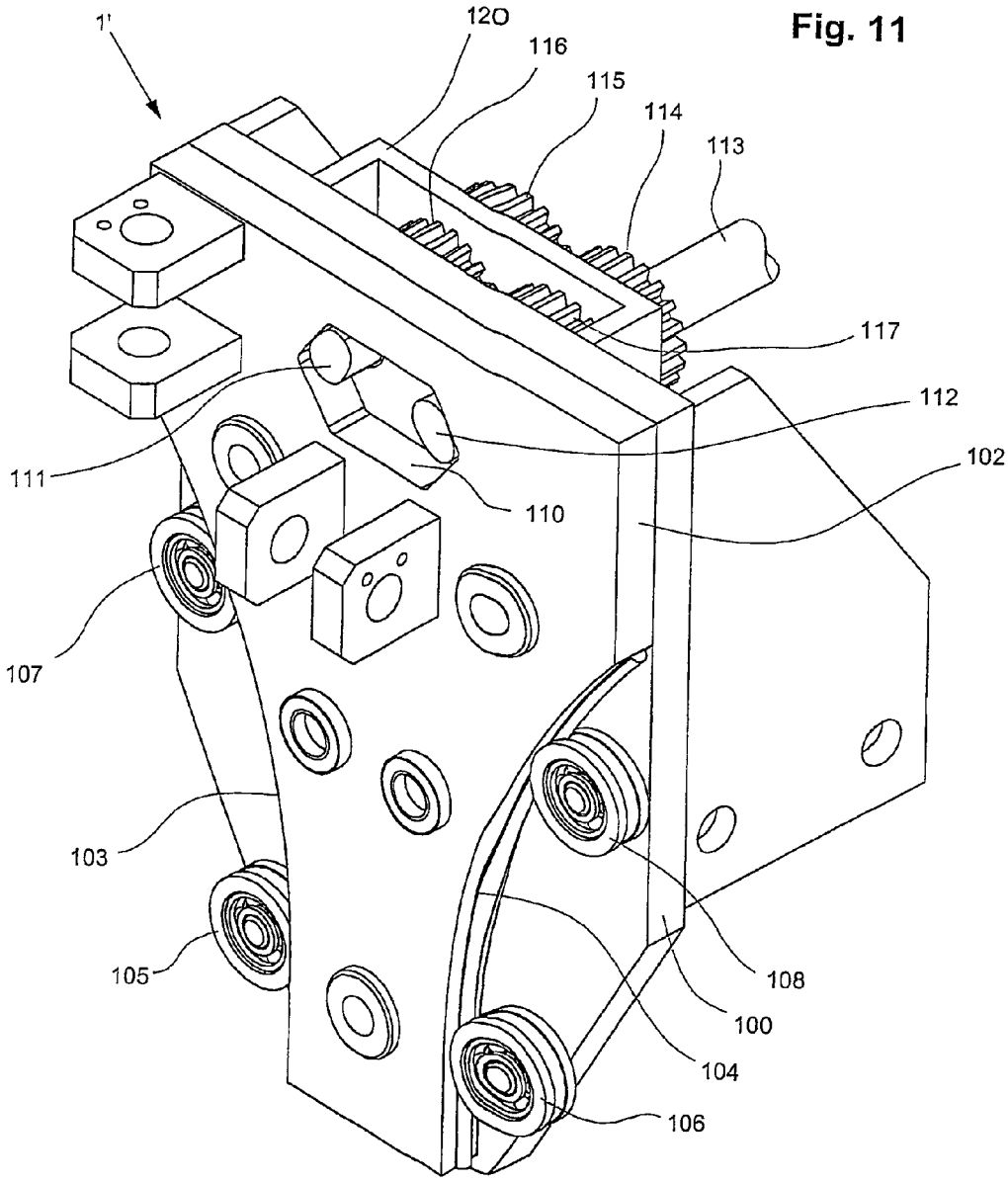
FIG. 11 shows a perspective illustration of a second embodiment of a device for producing oscillating movements at the side seals of a roll casting strip machine.

FIG. 11 shows a further embodiment of a device 1' for generating oscillating movements on side seals of a roll strip casting machine. It once again comprises a fixed base plate 100, opposite which a further plate 102 connected with the side seal is moveably located. The side seal itself is not illustrated in FIG. 11, but the plate 102 is affixed in the holding frame of the side seal that receives a sealing plate already mentioned above.

The moveable plate 102 comprises two side guide surfaces 103, 104 along its outside circumference, which each lie on the circumference of a circle with the casting roll radius a and a center $D_3$, or $D_4$ (see FIG. 4 and FIG. 5) corresponding to the axis of rotation of the relevant casting roll 3, or 4. The guide surfaces 103, 104 are co-operatively connected with two guide roll pairs 105, 106, 107, 108 symmetrically located in relation to the vertical central plane of the base plate on the fixed base plate 100, of which one guide roll pair 105, 106 is located in a lower, and the other guide roll pair 107, 108 in an upper, extended area.

In the upper area of the moveable plate 102, a recess 110 that is symmetrical in relation to the vertical central plane of the same is located, into which two eccenters 111, 112 project through the base plate 100 from behind. The eccenters 111, 112 can be driven by a drive not shown in the drawing and located outside of the hot section via a drive shaft 113 and a gear wheel 144, 115; 116, 117 in a counter direction. The gear wheel 114 is located on the drive shaft 113, the gear wheel 115 engaged with the same sits on a shaft allocated to one eccenter 111 and is bearingly positioned in a holder 120, on which a further gear wheel 116 is also positioned, which engages a gear wheel 117 driven by the other eccenter 112.

The two eccenters 111, 112 and the inside surfaces of the recess 110 are matched to each other by means of friction closure in such a way that the moveable plate 102 remains in constant contact with the lower guide rolls 105, 106 with its guide surfaces 103, 104 during a rotation of the eccenters 111, 112, although the same is pressed alternately against one or the other upper guide roll 107, 108. In this way, the plate 102, and with it the side seal, carries out a kind of oscillating V movement alternately along one or the other casting roll edge 3*k*, or 4*k*. The lift of the sealing plates can preferably be from between 0 and 1 mm to between 0 and 20 mm.

The side seal with the moveable plate 102 as well as the base plate 100 with the holder 120 and the gear wheels 115, 116, 117 bearingly positioned in the holder 120 form a unit which is inserted from below following pre-heating in order to fixedly drive the gear wheel 114 located on the drive shaft 113, whereby the gear wheel 115 is brought into engagement with the fixed gear wheel 114.

In principle, the two upper guide rolls 107, 108 of FIG. 11 can be omitted, and the guiding of the moveable plate 102 can be carried out by the two eccenters 111, 112 engaging the recess 110. The plate 102 would then be held and guided by these eccenters 111, 112 on the one hand, and by the two guide rolls 105, 106 located at the lower end on the other.

In addition, a spring, preferably a pressure spring, can be located between the plate 102 and the base plate 100, which effects that the moveable plate 102 is always pressed against the eccenters in a downward direction with the inside surfaces of its recess 110, so that a gap-free positive abutment by means of friction closure of the eccenters is guaranteed.

The invention claimed is:

1. A method of operating a strip casting machine for producing a metal strip, comprising:

continuously pouring molten metal between two casting rolls forming a casting gap;

adjusting sealing plates against facing surfaces of the two casting rolls for limiting a side of the casting gap;

setting the sealing plates into an oscillating movement transverse to a direction of a rotational axis of the casting rolls during a casting operation;

moving the sealing plates in an oscillating manner in and opposite to a direction of a periphery of the casting rolls, whereby said moving occurs alternately along one or the other of casting roll edges.

2. The method of claim 1, wherein a frequency of the oscillating movement of the sealing plate is variable.

3. The method of claim 2, wherein the oscillating frequency is based on a casting speed.

4. The method of claim 1, wherein said moving of the sealing plates in the direction of the periphery of a respective one of the casting rolls is faster, equal to, or slower than a movement of a rotating surface of the casting rolls.

5. The method of claim 4, wherein said moving of the sealing plates against the direction of the periphery of a respective one of the casting rolls is faster, equal to, or slower than the movement of the sealing plates in the direction of the periphery.

6. The method of claim 1, wherein a lift of the sealing plates is +/−0.5 mm to +/−10.0 mm.

7. The method of claim 6, wherein, when the sealing plates are moved in a direction of movement of a casting strip, the lift of the sealing plates occurs at a speed as much as 10% faster than the speed of the casting strip.

8. The method of claim 6, wherein, when the sealing plates are moved in a direction opposite a direction of movement of a casting strip, the lift of the sealing plates occurs at a speed as much as 10 times slower than a speed of the sealing plates in a direction of movement of the casting strip.

9. A device for performing a strip casting method, comprising:

two casting rolls arranged to form a casting gap;

side seals each having a sealing plate adjustable against facing surfaces of said casting rolls for limiting a side of the casting gap;

a drive unit for generating oscillating movements of said side seals by:

setting the sealing plates into an oscillating movement transverse to a direction of a rotational axis of said casting rolls during a casting operation; and moving said sealing plates in an oscillating manner in and opposite to a direction of a periphery of said casting rolls, whereby said sealing plates are moved alternately along one or the other of casting roll edges;

base plates each fixed adjacent to a respective one of said side seals;

a plurality of guide elements disposed on said side seals and said base plates, said guide elements having a first section for steering each of said side seals along a first casting roll edge, and a second section for steering each of said side seals along a second casting roll edge; and an adjustment mechanism for alternately adjusting a position of said side seals via said first section or said second section of said guide elements.

10. The device of claim 9, wherein said guide elements disposed on said side seals comprise circular guides, at least one of said circular guides being located in a lower area at the casting gap, and two of said circular guides being located in an upper, expanded area of said side seals such that guide surfaces of said circular guides facing outside edges of said side seals each lie on a circumference of a circle with a radius of each of said casting roll and a center corresponding to an axis of rotation of a respective one of said casting rolls.

11. The device of claim 10, wherein said guide elements disposed on said base plate are formed as guide rolls to be brought into contact with said guide surfaces.

12. The device of claim 11, wherein each of said guide rolls is bearingly and rotatably positioned on a bolt connected with pistons adjustably located within a fixed guide cylinder forming said adjustment mechanism, said pistons are adjustable vertically in relation to a relevant guide surface.

13. The device of claim 12, wherein each guide cylinder for said guide rolls is arranged in the casting gap area to be adjusted against lower guide surfaces, and is affixed by a holder to a lower position cylinder firmly connected with a respective one of said base plates.

14. The device of claim 13, wherein said drive unit comprises a lower piston/cylinder unit held between an upper base plate-affixed holder and a holder affixed to a respective one of said side seals, said lower piston/cylinder unit extending almost vertically between two upper position cylinders, said holder affixed to said lower position cylinder is positioned above a lower position cylinder.

15. The device of claim 12, wherein each guide cylinders for said guide rolls is adjustable against guide surfaces of an upper circular guide are affixed symmetrically to a vertical central plane of a respective one of said base plates and are firmly affixed to said respective one of said base plates.

16. The device of claim 10, wherein said lower circular guide comprises two guide surfaces directed towards outside edges of said side seals, and has a rounded cross-section to be brought into contact with correspondingly shaped circumferential surfaces of a respective guide roll.

17. The device of claim 10, wherein said upper circular guides each comprise a guide surface directed against an outside edge of a respective one of said side seals, and each has a rounded cross-section to be brought into contact with a correspondingly-shaped circumferential surface of a respective guide roll.

18. The device of claim 9, wherein said guide elements disposed on said side seals are shaped as guide surfaces arranged at an outside circumference of a moveable plate connected with a sealing plate holding frame, said guide surfaces lying on a circumference of a circle having a radius equal to a radius of one of said casting rolls and having a center coincident with an axis of rotation of a respective one of said casting rolls.

19. The device of claim 18, wherein said guide elements disposed on said base plates are shaped as two guide roll pairs arranged symmetrically with respect to a vertical central plane of each of said base plates, a first guide roll pair being located in a lower area of a respective one of said side seals, and a second guide roll pair being located in an upper expanded area of said respective one of said side seals, said guide surfaces of said moveable plate being in constant contact with said lower guide rolls and can be alternately pressed against one or the other upper guide roll.

20. The device of claim 19, wherein said moveable plate with said guide surfaces further has a recess in an upper area thereof, said recess being symmetrical to a vertical central plane of said moveable plate, two eccenters connected with a drive project into said recess, said drive being operable to drive in a counter direction such that said eccenters and an inside surface of said recess are shaped to suit each other such that said moveable, plate can be pressed alternately against one of said upper guide rolls with one of said guide surfaces during rotation of said eccenter.

* * * * *